US008757685B2

(12) United States Patent
Chang

(10) Patent No.: US 8,757,685 B2
(45) Date of Patent: Jun. 24, 2014

(54) MAGNETIC LOCK WITH AUXILIARY MECHANICAL LOCKING OR RESISTANCE

(75) Inventor: Jason Chang, Fengxian (CN)

(73) Assignee: Shanhai One Top Corporation (CN)

( * ) Notice: Subject to any disclaimer, the term of this patent is extended or adjusted under 35 U.S.C. 154(b) by 595 days.

(21) Appl. No.: 12/374,029

(22) PCT Filed: Jul. 19, 2007

(86) PCT No.: PCT/AU2007/001003

§ 371 (c)(1),
(2), (4) Date: Jul. 21, 2009

(87) PCT Pub. No.: WO2008/009057

PCT Pub. Date: Jan. 24, 2008

(65) Prior Publication Data

US 2009/0302619 A1 Dec. 10, 2009

(30) Foreign Application Priority Data

Jul. 20, 2006 (AU) ..... 2006903924
Aug. 29, 2006 (AU) ..... 2006904705

(51) Int. Cl.
*E05C 17/56* (2006.01)

(52) U.S. Cl.
USPC ..... 292/251.5

(58) Field of Classification Search
CPC .. E05B 65/1053; E05B 47/0012; E05C 19/16
USPC ..... 292/92, 251.5, 144, DIG. 15, DIG. 65, 1, 292/336.3, 93, 94, 252, 341.15–341.17
See application file for complete search history.

(56) References Cited

U.S. PATENT DOCUMENTS

| | | | | | |
|---|---|---|---|---|---|
| 3,764,172 | A | * | 10/1973 | Standke | 292/15 |
| 4,135,377 | A | * | 1/1979 | Kleefeldt et al. | 70/264 |
| 4,656,850 | A | * | 4/1987 | Tabata | 70/276 |
| 4,663,800 | A | * | 5/1987 | Mettenleiter et al. | 16/51 |
| 4,807,454 | A | * | 2/1989 | Sengupta et al. | 70/277 |
| 4,840,411 | A | * | 6/1989 | Sowersby | 292/251.5 |
| 4,915,431 | A | * | 4/1990 | Bailey | 292/251.5 |
| 4,981,312 | A | * | 1/1991 | Frolov | 292/251.5 |
| 5,016,929 | A | * | 5/1991 | Frolov | 292/251.5 |
| 5,065,136 | A | * | 11/1991 | Frolov et al. | 340/545.2 |
| 5,184,855 | A | * | 2/1993 | Waltz et al. | 292/251.5 |
| 5,184,856 | A | * | 2/1993 | Waltz | 292/251.5 |
| 5,228,730 | A | * | 7/1993 | Gokcebay et al. | 292/144 |
| 5,382,167 | A | * | 1/1995 | Janson, Jr. | 439/38 |
| 5,496,079 | A | * | 3/1996 | Frolov | 292/251.5 |
| 5,516,166 | A | * | 5/1996 | Frolov et al. | 292/251.5 |
| 5,641,187 | A | * | 6/1997 | Frolov | 292/251.5 |

(Continued)

FOREIGN PATENT DOCUMENTS

AU 199924986 11/1999

*Primary Examiner* — Kristina Fulton
*Assistant Examiner* — Nathan Cumar
(74) *Attorney, Agent, or Firm* — Stephen C. Beuerle; Procopio Cory Hargreaves & Savitch LLP

(57) ABSTRACT

A lock is disclosed including magnetic and mechanical locking features. The mechanical lock means operates in response to an attempt to force open the lock. The mechanical lock means includes a pin and at least one locking element; the mechanical lock means operates by engagement of the at least one locking element with a recess.

1 Claim, 5 Drawing Sheets

(56) References Cited

U.S. PATENT DOCUMENTS

| | | | | |
|---|---|---|---|---|
| 5,758,913 | A * | 6/1998 | Roth et al. | 292/251.5 |
| 5,865,483 | A * | 2/1999 | Dubravin | 292/251.5 |
| 5,964,487 | A * | 10/1999 | Shamblin | 292/144 |
| 6,053,546 | A * | 4/2000 | Frolov | 292/251.5 |
| 6,260,892 | B1 * | 7/2001 | Chang | 292/251.5 |
| 6,295,702 | B1 * | 10/2001 | Bauer | 24/303 |
| 6,386,597 | B1 | 5/2002 | Walsh, III | |
| 6,647,753 | B2 * | 11/2003 | Engler | 70/472 |
| 6,668,606 | B1 * | 12/2003 | Russell et al. | 70/278.3 |
| 6,857,671 | B2 * | 2/2005 | Fly | 292/251.5 |
| 7,516,992 | B2 * | 4/2009 | Peng | 292/326 |
| 2004/0026933 | A1 * | 2/2004 | Smith | 292/251.5 |

* cited by examiner

MAGNETIC LOCK WITH AUXILIARY MECHANICAL LOCKING OR RESISTANCE

TECHNICAL FIELD

This invention relates to a lock such as might be used to retain a door in an open or closed position.

BACKGROUND TO THE INVENTION

Locks are commonly used to retain doors or windows or the like in either an open or closed condition. In the case where it is desirable control the lock from a remote location, an electrically operated lock may be used. One form of electrically operated lock is an electromagnetic lock. These typically comprise an armature of ferrous material and an electromagnet. Activation of the electromagnet causes strong magnetic attraction between the armature and electromagnet. It is necessary for current to flow through the electromagnet to maintain the attraction. Deactivation of the electromagnet allows the armature to release from the electromagnet.

In the case of security doors in commercial premises or the like, electromagnetic locks are sometimes used which require a force of about 2000N to 5000N to break the attraction between the armature and the electromagnet. In order to provide such strong magnetic attraction it is necessary to use a strong electromagnet and a correspondingly large armature. In addition, a current of approximately between 40 mA up to 400 mA must constantly flow through the electromagnet whilst it is retaining the door.

The following formula shows the general equation determining the electromagnet holding force:

$$F=K*(B_g)^2*A$$

Where

F is the holding force in Newton,

K is the constant, $B_g$ is full density of magnetism ($Wbm^2$)

A is the surface area of the electromagnet ($m^2$)

It would be advantageous to provide a remotely operable lock with an adequately strong locking action which uses either a smaller amount of raw materials during construction or which uses less electricity during operation than existing locks.

SUMMARY OF THE INVENTION

The present invention provides a lock including magnetic lock means and mechanical lock means.

BRIEF DESCRIPTION OF THE DRAWINGS

An embodiment of the present invention will now be described, by way of example only, with reference to the accompanying drawings, in which:

FIG. 7(*b*) shows the lock of FIG. 7(*a*) in another position; and

FIG. 7(*c*) shows the lock of FIG. 7(*a*) in yet another position.

DETAILED DESCRIPTION OF THE PREFERRED EMBODIMENT

Figure 1:
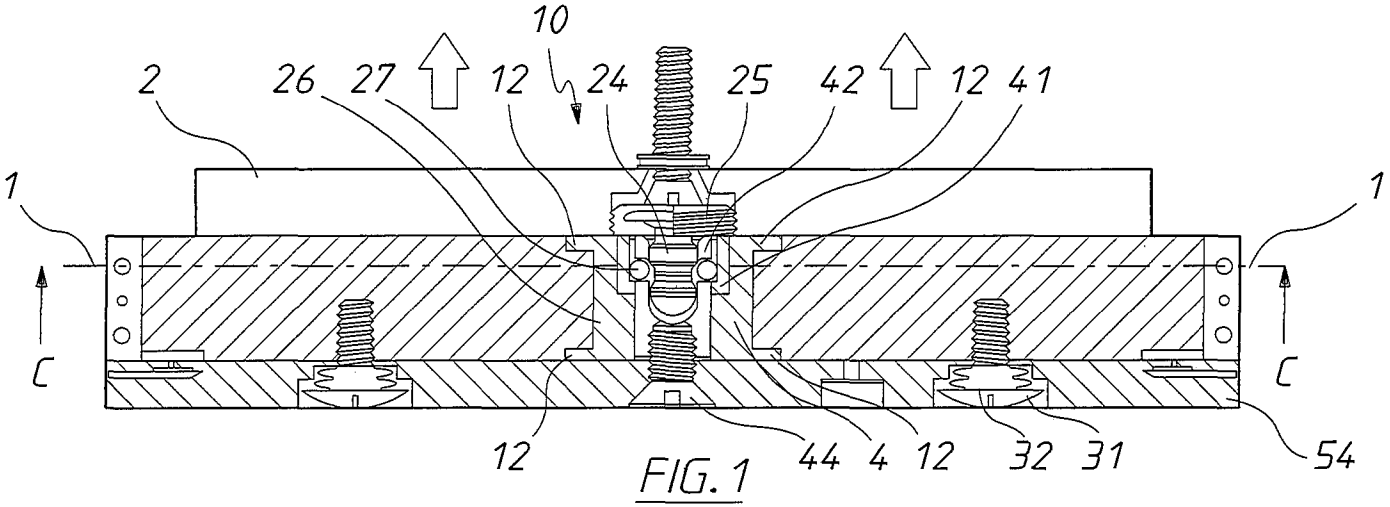
FIG. 1 is a cross sectional view along the line A-A of FIG. 2 of a lock according to an embodiment of the present invention.
Figure 2:
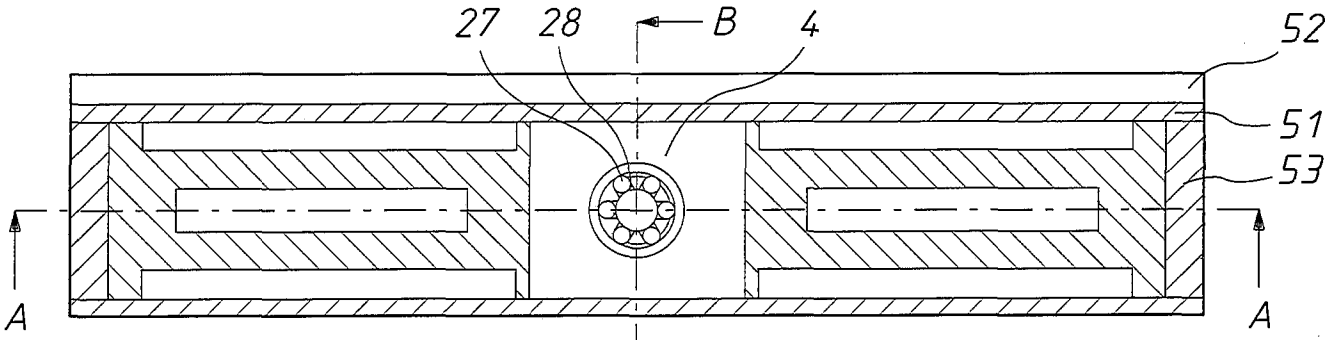
FIG. 2 is a cross sectional view of the lock of FIG. 1 along the line C-C.

Referring to FIG. 1, a lock 10 is shown including magnetic lock means in the form of two electromagnets 1 which, when supplied with electric current, are magnetically attracted to armature 2.

Lock 10 further includes mechanical lock means including pin 24 which has a groove 26 provided about its shaft. Pin 24 is attached to armature by way of screw thread 25.

A hollow sleeve 42 is affixed to backing plate 54 by way of screw 44 and surrounds pin 24. Six locking elements in the form of generally spherical balls 27 are mounted in sleeve 42. Each ball 27 sits in a through hole 28 in sleeve 42. Each through hole 28 narrows slightly at the end nearest the centre of the sleeve. This allows each ball 27 to be inserted into hole 28 from the outside of the sleeve, and each ball is prevented from passing right through the hole 28 by the narrowed portion.

The electromagnets 1 are connected to a centre piece 4 which carries a shoulder 41. Electromagnets 1 are mounted to backing plate 54 by way of screws 31 packed with a stack of sprung washers 32. Centre piece 4 sits between electromagnets 1 and is maintained in a substantially fixed relationship to the electromagnets by way of flanges 12. Sprung electrical contact fingers 35 bear against flat contacts 11 to provide electrical connections to the electromagnets 1.

When electric current is supplied to electromagnets 1 they become attracted to armature 2. An attempt to open the door whilst the electromagnets are active causes movement of armature 2 along with electromagnets 1 and centre piece 4 in the direction indicated by the bold arrows in FIG. 1 by way of compression of sprung washers 32 (note compression of washers 32 in FIG. 3). The electromagnets 1, centrepiece 4 and shoulder 41 move as one to the position shown in FIG. 3. The sleeve 42 remains fixed to backing plate 54.

Figure 3:
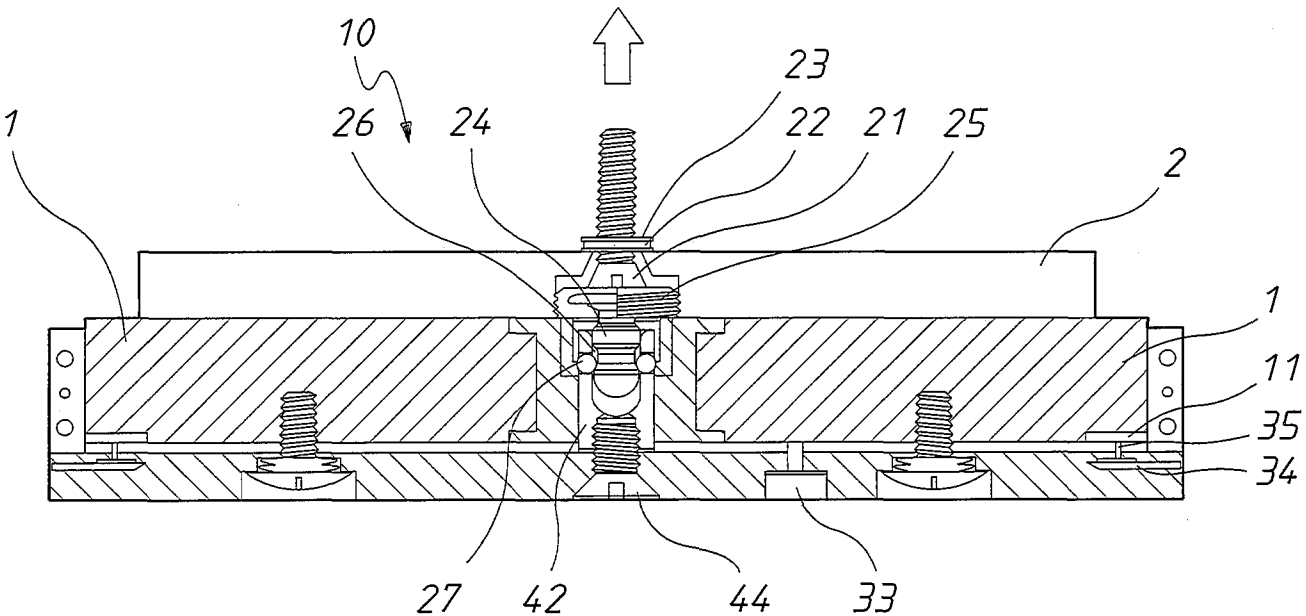
FIG. 3 is a cross sectional view of the lock of FIG. 2, but in a position when a force is being exerted upon the door being locked.

Comparing FIGS. 1 and 3, in FIG. 1 balls 27 are out of engagement with groove 26. However, in FIG. 3, movement of shoulder 41 has effected a ramping movement which has guided balls 27 into engagement with groove 26. Thereafter, increased force applied to the armature in the direction shown by the white arrow in an attempt to open the door is resisted by engagement of balls 27 within groove 26 of pin 24. Thus, in FIG. 3 both the magnetic action of electromagnets 1 and the physical engagement of balls 27 and pin 24 simultaneously serve to resist separation of the armature from the electromagnets and thus keep the door closed.

It has been found that, when compared to locks that rely on electromagnetic attraction alone, locks according to embodiments of the invention can provide the same resistance to opening but use electromagnets of reduced capacity. This means it is possible to use smaller electromagnets and thus use less raw materials to achieve the same strength of lock as in the case of known electromagnetic locks, with a consequential drop in power consumption due to the reduced capacity of the electromagnet.

Microswitch 33 is configured to detect movement of the electromagnets 1 between the positions shown in FIGS. 1 and 3. This allows remote detection of a force being applied to a door that is sufficient to compress sprung washers 32 and may indicate an attempt to force open the door.

Figure 4:
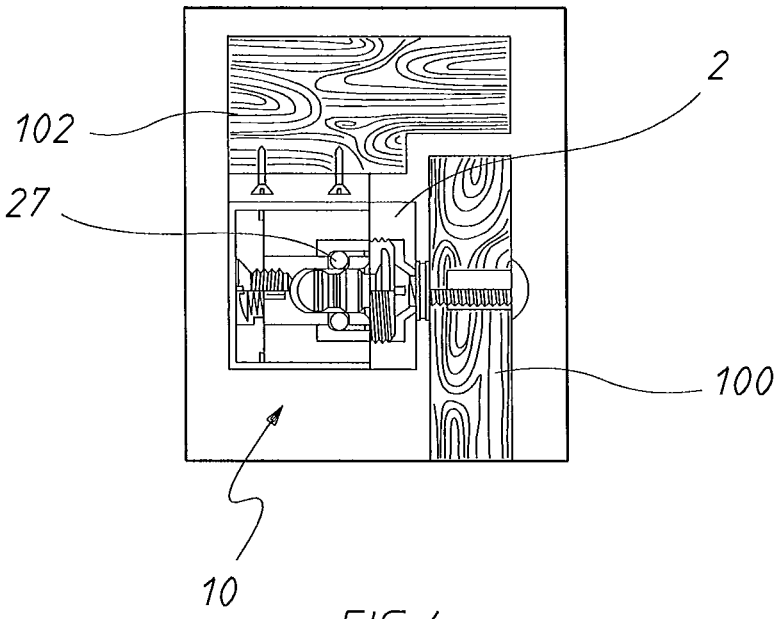
FIG. 4 is a cross section view of the lock of FIG. 2 along the line B-B and shown affixed to a door in a position when a force is being exerted upon the door.
Figure 5:
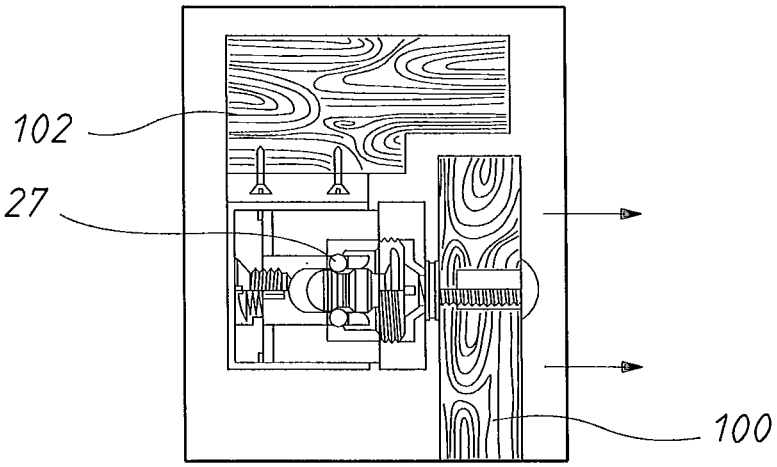
FIG. 5 shows the lock in the same view as shown in FIG. 4, but in the position shown in FIG. 3.
Figure 6:
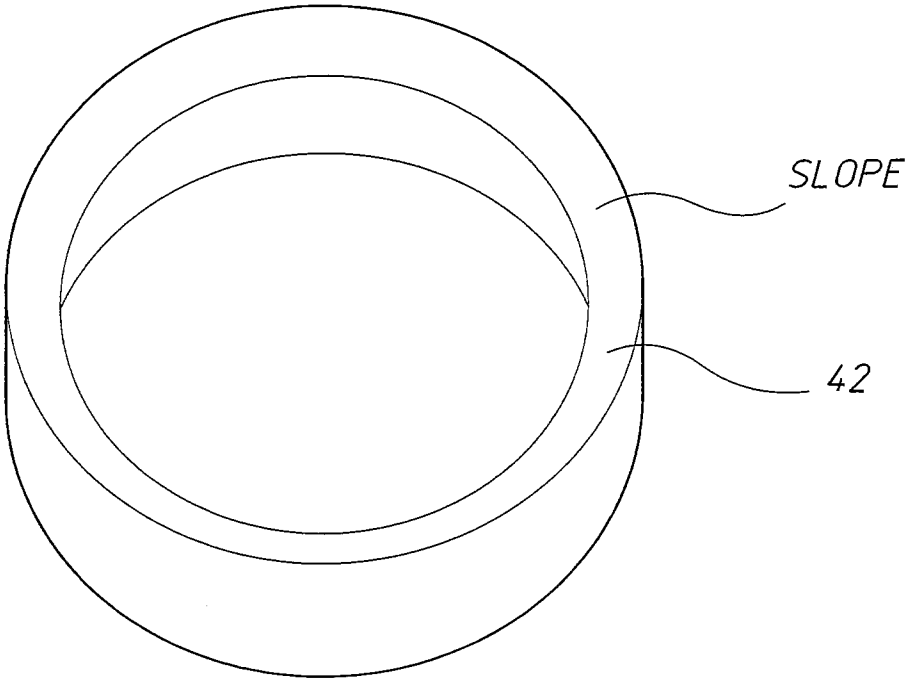
FIG. 6 shows an enlarged perspective view of the sleeve of the lock of FIG. 1'

Comparing FIGS. 4 and 5, the lock is shown at rest in FIG. 4 with the lock affixed to doorjamb 102 and armature 2 affixed to door 100. At FIG. 5 the lock is shown when a forced attempt is being made to open the door 100. Note that in FIG. 5, balls 27 have been pushed into engagement with groove 26 of pin thus providing mechanical resistance to separation of armature and electromagnets.

Referring again to FIG. 1, when the electromagnets deactivated there is no attraction between the armature 2 and the electromagnets 1. Thus, if an attempt it made to open the door, the armature easily separates from the electromagnets. Pin 24 is free to release from sleeve 42 as balls 27 are not held in engagement with groove 26 by shoulder 41.

Figure 7C:
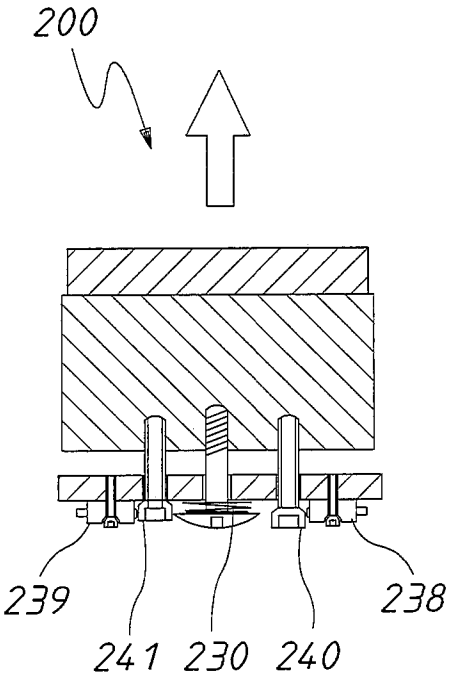
FIG. 7(*a*) shows a lock according to a second embodiment of the invention.
Figure 7B:
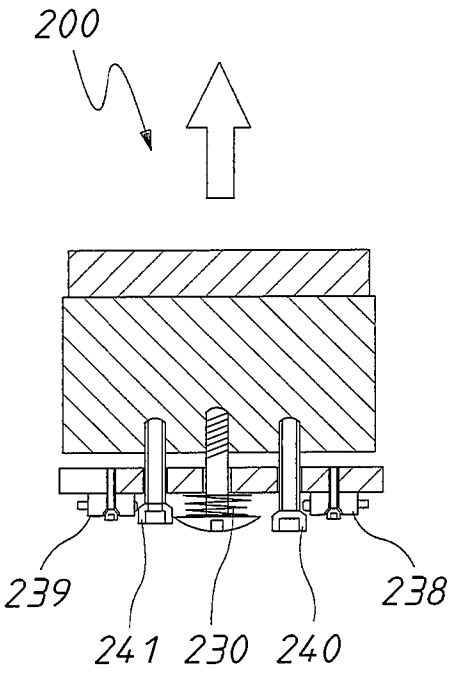
Figure 7A:
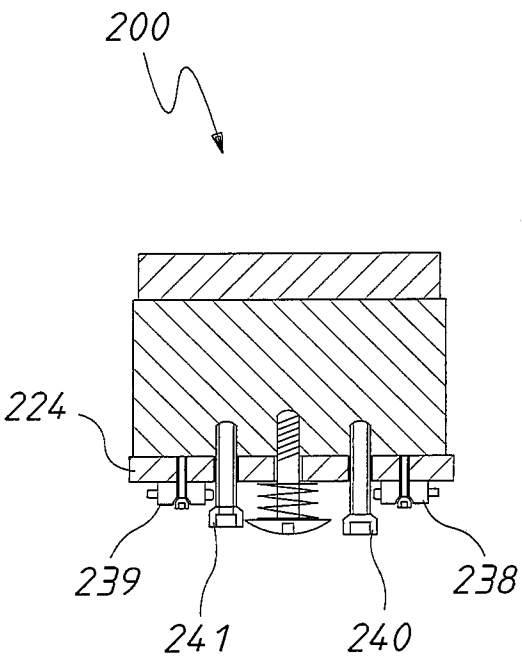

Referring to FIG. 7(*a*), an alternative embodiment of the invention is shown. In this version two microswitches 238, 239 are used. The microswitches are actuated by the heads of actuation screws 240, 241. The depth of insertion of each of screws 241, 240 into plate 224 dictates the force required to actuate either of microswitches 239, 240.

Referring to FIG. 7(*b*), a moderate force is being applied to device 200 which is comparable to the force that might be applied by a person attempting to push open a door. The force is balanced by compression of spring 230. It can be seen that microswitch 239 has become actuated by the head of actuation screw 241.

Referring to FIG. 7(*c*), a large force is being applied to device 200 which is comparable to the force that might be applied by a person attempting to force open a door. The force is balanced by further compression of spring 230. It can be seen that microswitch 238 has become actuated by the head of actuation screw 240.

Device 200 includes a radio transmitter device which can transmit signals indicating a condition of device 200 based on the positions of microswitches 239, 240. If neither switch is actuated then this indicates that the door is not being pushed.

If switch 239 is actuated then this indicates that somebody may be attempting to open the door. The radio transmitter circuit may transmit a signal indicating this. This may be received at a local unit which sounds an alarm to indicate to the person that the door is locked.

If switches 239 and 240 are actuated then this indicates that somebody may be making a forced attempt to break open the door. The radio transmitter circuit may transmit a signal indicating this. This may be received at a remote security console or the like to indicate to security personnel that a forced attempt may be being made to open the door to which device 200 is attached.

In the above described embodiment the lock was described as being used to retain a door in the closed position. Similarly, the lock can be used with windows and other building openings. Similarly, the lock can be used to keep a door or window or the like in the open position.

The lock described above utilised two electromagnets. Similarly, a greater or lesser number of electromagnets can be used.

The lock described above utilised one pin which provided a mechanical locking action. Similarly, more than one pin can be used.

The lock described above included electromagnets that were connected to their power supply by way of sprung finger contacts provided on the backing plate of the lock which made contact with terminals of the electromagnets when the electromagnets were installed in the lock. Similarly, the electromagnets could be hard wired.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A door lock, comprising: a backing plate that is mountable to a door frame;

an armature that is mountable to a door and having a front face, the armature including a pin extending from the front face, the pin including a recess in the form of a groove provided about a shaft of the pin;

an electromagnet moveably mounted to the backing plate for relative movement with respect to the backing plate and operating by electromagnetic attraction to the front face of the armature;

a sleeve fixedly mounted to the backing plate and including a plurality of locking elements;

a shoulder surrounding the sleeve, and configured to move with the electromagnet;

a mechanical lock comprising the pin, the sleeve, the shoulder, and the plurality of locking elements;

the mechanical lock operating by movement of the shoulder with respect to the sleeve which causes engagement of the plurality of locking elements with the groove of the pin;

the electromagnet movable with respect to the backing plate between a locked position, where the shoulder engages the locking elements with the groove to thereby engage the mechanical lock, and an unlocked position; the electromagnet spring-biased to the unlocked position; if an attempt is made to push open the door when the electromagnet is active, then the attraction of the electromagnet to the armature causes movement of the electromagnet along with the armature so that the electromagnet moves to the unlocked position which causes movement of the shoulder with respect to the sleeve to thereby cause the mechanical lock to operate to resist opening of the door; and if an attempt is made to open the door when the electromagnet is deactivated then the mechanical lock does not operate and thereby allows the door to be opened.

* * * * *